US005331766A

United States Patent [19]

Bennett

[11] Patent Number: 5,331,766

[45] Date of Patent: Jul. 26, 1994

[54] DEVICE FOR LOCKING WINDOWS

[76] Inventor: Robert A. Bennett, 170 Sturbridge Rd., Easton, Conn. 06612

[21] Appl. No.: 92,880

[22] Filed: Jul. 19, 1993

[51] Int. Cl.[5] ..... E05F 3/00

[52] U.S. Cl. ..... 49/449; 292/175; 292/DIG. 61; 292/DIG. 47

[58] Field of Search ..... 292/175, DIG. 61, DIG. 47, 292/163; 49/449, 450; 267/272, 158, 161

[56] References Cited

U.S. PATENT DOCUMENTS

| | | | |
|---|---|---|---|
| 410,535 | 9/1889 | Corrigan | 292/175 X |
| 744,654 | 11/1903 | Weaver | 292/175 |
| 1,516,995 | 11/1924 | Trigueiro | 292/175 |
| 1,718,995 | 7/1929 | Barnard | 292/175 X |
| 1,868,949 | 7/1932 | Pat | 292/175 X |
| 2,609,222 | 9/1952 | Severson | 292/175 |
| 2,657,086 | 10/1953 | Sweet | 292/175 |
| 2,676,826 | 4/1954 | Smith | 292/175 |
| 2,692,789 | 10/1954 | Rivard | 292/175 X |
| 3,233,932 | 2/1966 | Utterback | 292/175 |
| 4,763,885 | 8/1988 | Zamitter | 267/158 X |

FOREIGN PATENT DOCUMENTS

| | | | |
|---|---|---|---|
| 151665 | 10/1920 | United Kingdom | 267/272 |

*Primary Examiner*—Peter M. Cuomo
*Assistant Examiner*—Jerry Redman

[57] ABSTRACT

A device adapted for use in locking a window in closed position or in partially or fully open position which utilizes an elongated locking pin; and a flexible spiral shaped spring lying in a plane perpendicular to the direction of elongation of the pin. The spring has an inner end secured to the pin at a position intermediate the ends of the pin. The spring has an outer end with an opening therein.

2 Claims, 2 Drawing Sheets

DEVICE FOR LOCKING WINDOWS

BACKGROUND OF THE INVENTION

Many types of devices are known for locking double hung windows in a closed position and which when unlocked allow the windows to be opened or closed. The present invention is directed towards a device which can be used to lock double hung windows not only in closed position but also in any different position between fully open and fully closed.

SUMMARY OF THE INVENTION

Accordingly, it is an object of the present invention to provide a new and improved device for locking double hung windows in a closed position or in any other position between fully open and fully closed.

Another object of the invention is to provide a new and improved device of the character indicated which is durable, inexpensive and easy to install and operate.

These and other objects and advantages of the invention will either be explained or will become apparent from a study of the accompanying drawings and the detailed description set forth below.

In accordance with the principles of my invention, a device adapted for use in locking a window in a closed position or in a partially or fully open position utilizes an elongated locking pin; and a flexible spiral shaped spring lying in a plane perpendicular to the direction of elongation of the pin. The spring has an inner end which is secured to the pin at a position intermediate the ends of the pin and has an outer end with an opening therein.

In use, the upper and lower window frames of a double hung window are disposed in the desired position, closed, open or partially open. The frames have a wood, plastic or metal peripheral border. A straight horizontal bore is drilled through a selected point on the border of the inner frame and at least a portion of the border of the outer frame. The pin is inserted in the bore and provides the locking action. The spring lies flat against the border of the inner frame. A screw or the like is used to secure the outer end of the spring to the border of the inner frame. A portion of the pin extends outwardly from the inner frame.

In order to unlock the window, it is only necessary for the user to grasp the outwardly extending portion of the pin and pull it out. The spring provides enough play for the pin to be removed and replaced as necessary while the pin is held conveniently by the spring which remains secured to the inner frame by the screw.

DETAILED DESCRIPTION OF PREFERRED EMBODIMENT

Referring now to FIGS. 1–7, there is shown a double hung window having an outer frame having a solid outer border 10 and an inner frame having a solid outer border 12. A horizontal bore 16 is drilled through the border 12 and at least a portion of the border 10.

Figure 1:
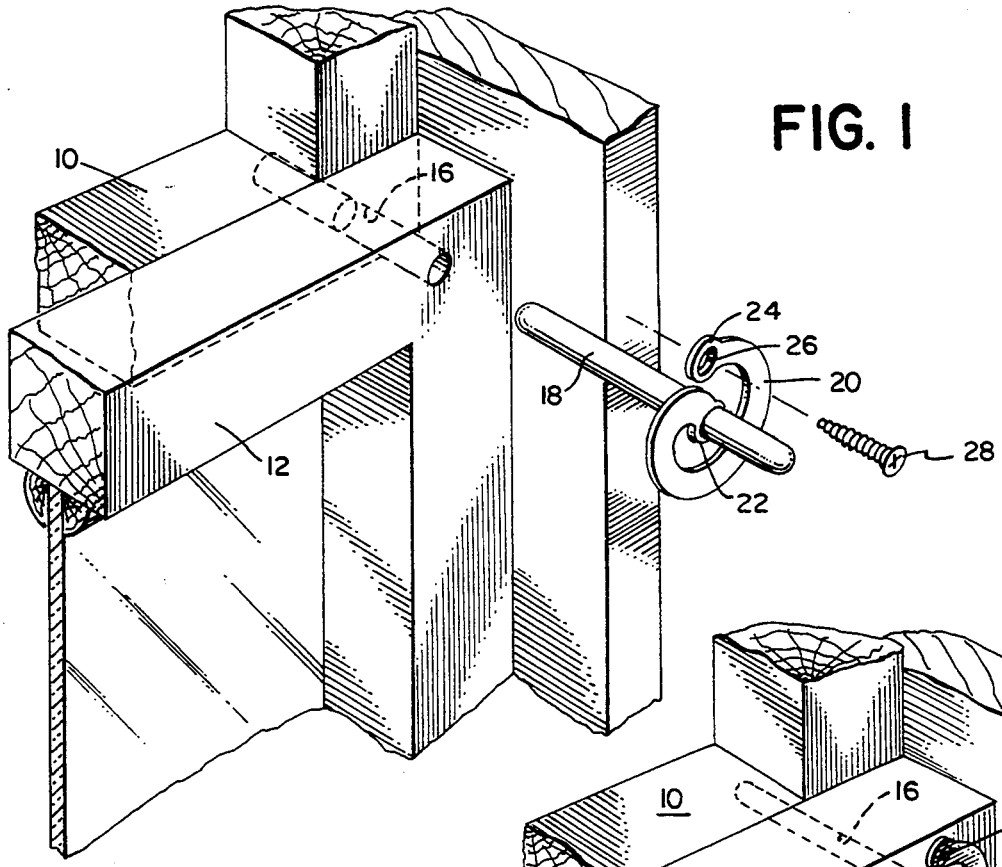
FIG. 1 is a perspective exploded view of the device.
Figure 2:
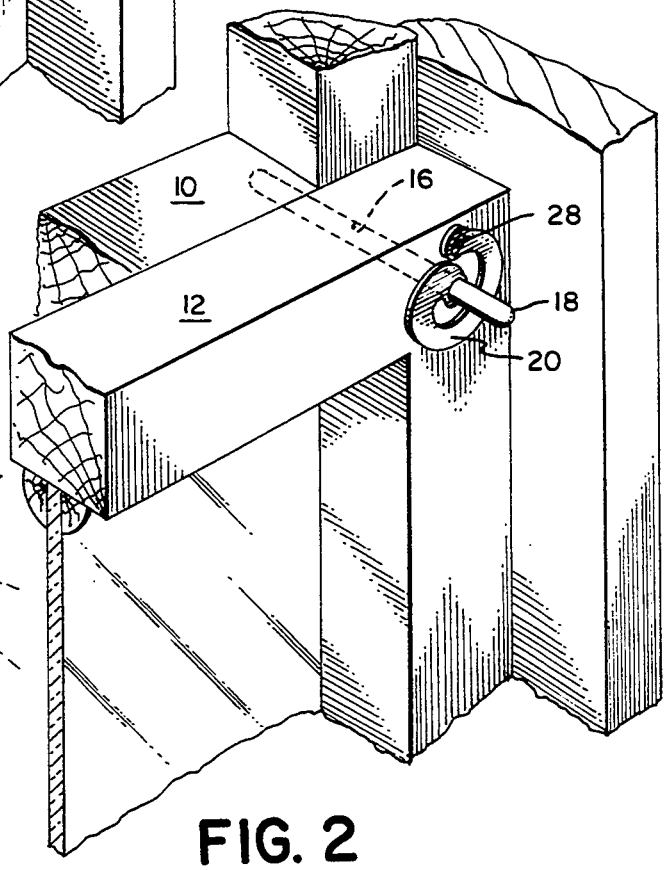
FIG. 2 is a perspective view showing the device in position, locking the two window frames in open position.
Figure 3:
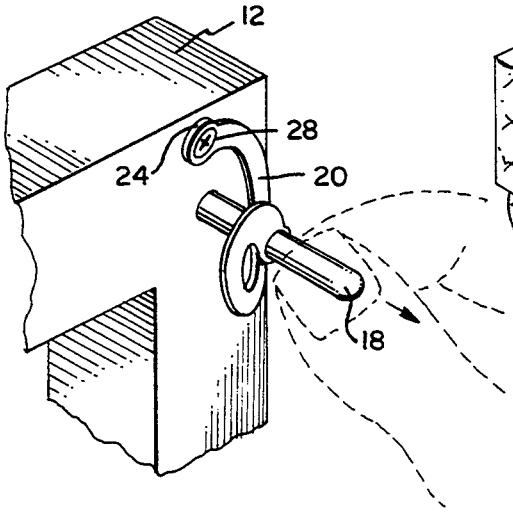
FIG. 3 is a detail perspective view illustrating the action of removing the device from locking position.
Figure 5:
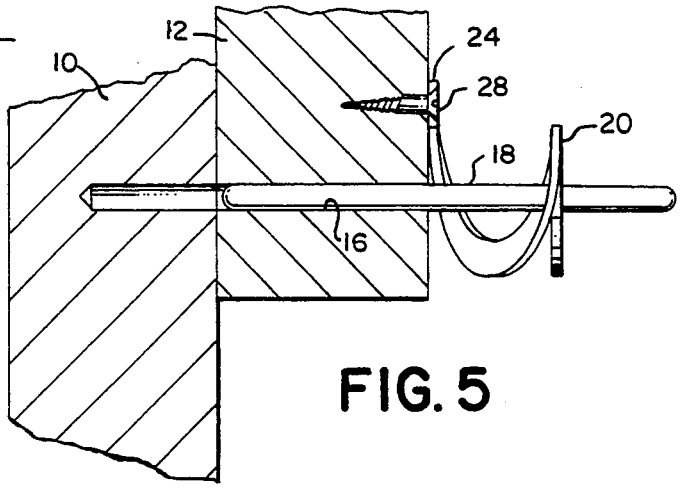
FIG. 5 is a detail cross sectional view of the structure shown in FIG. 3.
Figure 4:
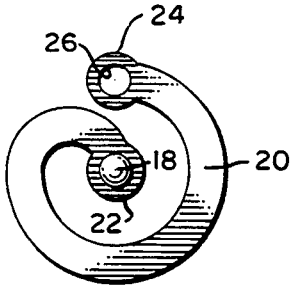
FIG. 4 is a plan view of the device before it is installed for use.
Figure 6:
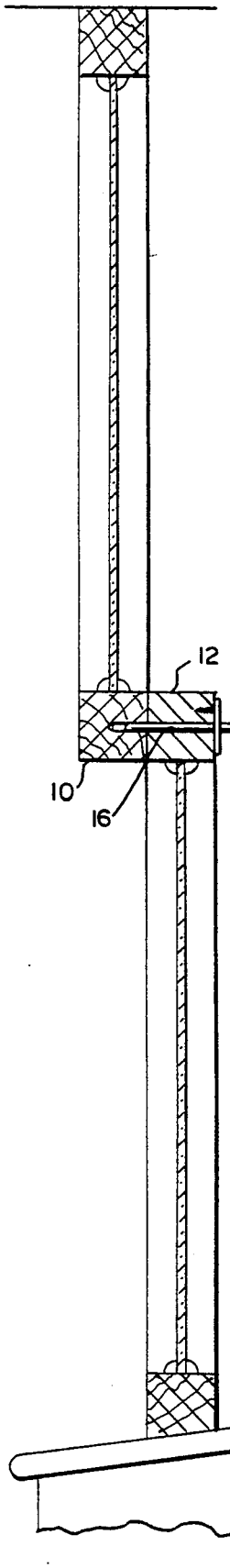
FIG. 6 is a cross sectional view showing the device used in locking the window frames in a closed position.
Figure 7:
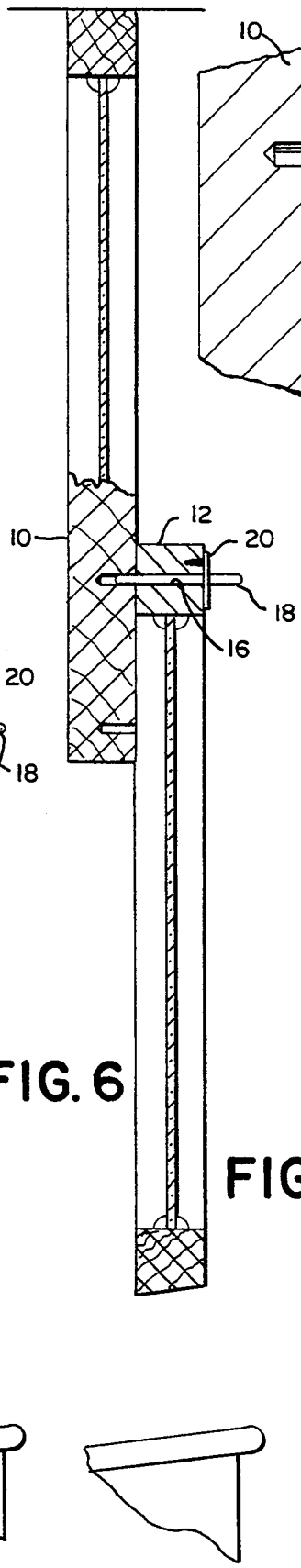
FIG. 7 is a view similar to FIG. 6 but showing the device used in locking the window frames in a partially open position.

When the frames are to be locked in closed position, borders 10 and 12 are positioned as shown in FIG. 7. When the frames are to be locked in partially open position, these borders are positioned as shown in FIG. 6. When these frames are to be locked in fully open position, these borders are positioned as shown in FIGS. 1 and 2.

The device comprises an elongated locking pin 18 formed typically of a suitable plastic and a flexible spiral shaped flat spring 20 formed from the same plastic and lying in a plane perpendicular to the direction of elongation of said pin. The spring has an inner end 22 secured to the pin at a position intermediate the ends of the pin and an outer end 24 with an opening 26 therein.

The bore 16 is at least long enough so that the portion of the pin between the end inserted in the bore and the spring extends fully into the bore. A screw 28 secures the outer end 24 to the border 12.

The pin can then be inserted into the bore to provide the desired locking action or can be removed while the spring remains secured by the outer end to the border.

While the invention has been described with particular reference to the drawings and detailed description, the protection sought is to be limited only by the terms of the claims which follow.

What is claimed is:

1. A device adapted for use in locking a window in a closed position or in a partially or fully open position, said device comprising:

an elongated cylindrical locking pin having two opposed ends;

a flat flexible spiral shaped spring lying in a single plane perpendicular to the direction of elongation of said pin, the spring having an inner end secured to the pin at a position intermediate the ends of the pin, the inner end having an opening through which the pin extends, the pin being secured immovably to the spring, the spring having an outer end with an opening therein; and a screw removably disposed in the opening in the outer end of the spring.

2. The device of claim 1 further including a structure having an adjacent portion supporting the window and wherein one end of the pin is removably inserted in a bore in the window with the spring bearing against the window and the other end of the pin extending outwardly from the spring, the other end of the spring being removably secured by said screw to said adjacent portion.

* * * * *